US010501884B2

(12) United States Patent
Uttridge

(10) Patent No.: US 10,501,884 B2
(45) Date of Patent: Dec. 10, 2019

(54) FLEXIBLE APPARATUS INCLUDING MOVEABLE ATTACHMENT POINTS AND RELATED DEVICES

(71) Applicant: Mark Uttridge, Raleigh, NC (US)

(72) Inventor: Mark Uttridge, Raleigh, NC (US)

( * ) Notice: Subject to any disclaimer, the term of this patent is extended or adjusted under 35 U.S.C. 154(b) by 0 days.

(21) Appl. No.: 15/916,849

(22) Filed: Mar. 9, 2018

(65) Prior Publication Data

US 2018/0258578 A1 Sep. 13, 2018

Related U.S. Application Data

(60) Provisional application No. 62/470,296, filed on Mar. 12, 2017.

(51) Int. Cl.

| | |
|---|---|
| ***D06F 57/12*** | (2006.01) |
| ***A47G 25/50*** | (2006.01) |
| ***A47G 25/44*** | (2006.01) |
| ***A47G 25/08*** | (2006.01) |

(52) U.S. Cl.

CPC ..... *D06F 57/12* (2013.01); *A47G 25/08* (2013.01); *A47G 25/44* (2013.01); *A47G 25/50* (2013.01)

(58) Field of Classification Search

CPC ..... D06F 57/12; A47G 25/08; A47G 25/50; A47G 25/44; A45F 2003/142

USPC ..... 24/69 R, 69 ST

See application file for complete search history.

(56) References Cited

U.S. PATENT DOCUMENTS

| | | | | | |
|---|---|---|---|---|---|
| 1,342,626 | A * | 6/1920 | Frank | A47G 25/08 | 211/107 |
| 3,563,430 | A * | 2/1971 | Forrest | A45F 5/00 | 224/255 |
| 4,387,873 | A * | 6/1983 | Pavlo | A61M 5/1415 | 211/113 |
| 4,846,430 | A * | 7/1989 | Ke | A47G 25/00 | 248/215 |
| 4,863,083 | A * | 9/1989 | Chen | A63C 11/025 | 224/663 |
| 5,642,842 | A * | 7/1997 | Taras | A45F 5/00 | 224/250 |
| 5,690,261 | A * | 11/1997 | Moore | A45F 3/14 | 206/278 |
| 6,371,346 | B1 * | 4/2002 | Sharma | A45F 3/14 | 224/195 |
| 6,446,849 | B1 * | 9/2002 | Schleifer | A43B 5/0425 | 224/258 |
| D508,323 | S * | 8/2005 | Douglas | D3/328 | |
| 7,810,654 | B1 * | 10/2010 | Wang | A47G 25/06 | 211/106.01 |
| 8,177,075 | B2 * | 5/2012 | Hathorn | A47F 5/0006 | 211/113 |
| 8,291,552 | B2 * | 10/2012 | Gopal | A44B 11/125 | 24/68 CD |
| 8,783,475 | B2 * | 7/2014 | Carver | A47G 25/08 | 211/113 |
| 9,622,607 | B2 | 4/2017 | Trusiak et al. | | |

(Continued)

*Primary Examiner* — Stanton L Krycinski

(74) *Attorney, Agent, or Firm* — Stanek Lemon Crouse & Meeks

(57) ABSTRACT

An apparatus can include a non-rigid member including a top end and a bottom end. A plurality of movable attachment points can be configured to be variably space apart along the non-rigid member between the top end and the bottom end. First and second hooks can be coupled to each of the plurality of movable attachment points.

14 Claims, 6 Drawing Sheets

(56) References Cited

U.S. PATENT DOCUMENTS

| | | | | |
|---|---|---|---|---|
| 10,081,306 | B2 * | 9/2018 | Zaccaria | B60R 7/10 |
| 2003/0116688 | A1 * | 6/2003 | Furukawa | A47F 5/0006 248/339 |
| 2007/0119881 | A1 * | 5/2007 | Murphy | A47G 25/743 223/97 |
| 2008/0035523 | A1 * | 2/2008 | Lemire | A45C 13/005 206/774 |
| 2009/0007389 | A1 * | 1/2009 | Pfannkuch | A47G 25/08 24/3.12 |
| 2009/0184141 | A1 * | 7/2009 | Marino | D06F 57/12 223/69 |
| 2010/0122961 | A1 * | 5/2010 | Moreau | A47G 25/16 211/85.7 |
| 2014/0151411 | A1 * | 6/2014 | Anderson | A45C 13/30 223/88 |

* cited by examiner

FLEXIBLE APPARATUS INCLUDING MOVEABLE ATTACHMENT POINTS AND RELATED DEVICES

CROSS-REFERENCE TO RELATED APPLICATION

This application claims priority to U.S. Provisional Patent Application Ser. No. 62/470,296, entitled Portable Equipment Ventilation, Storage and Maintenance System filed in the United States Patent and Trademark Office on Mar. 12, 2017, the content of which is incorporated herein in its entirety.

BACKGROUND

Participants in active sports such as hockey and football wear garments and protective gear. After participating in the sport, the garments and gear can become dirty and wet from the player's perspiration. Some players place the garments and gear into a bag or into a pile within a locker, which can produce mildew and foul odors. A solution to this problem is the proper air drying of the garments and gear.

SUMMARY

Embodiments according to the invention can provide flexible apparatus including moveable attachment points and related devices. Pursuant to these embodiments, an apparatus can include a non-rigid member including a top end and a bottom end. A plurality of movable attachment points can be configured to be variably space apart along the non-rigid member between the top end and the bottom end. First and second hooks can be coupled to each of the plurality of movable attachment points.

In some embodiments, an apparatus can include a flexible strap including a top end and a bottom end. A plurality of movable cam activated attachment points can be configured to be space apart along the flexible strap between the top end and the bottom end. First and second hooks can be coupled to each of the plurality of movable attachment points.

In some embodiments, an apparatus can include a cam activated attachment point including a channel through which a flexible strap can be threaded. A cam lever can be movable between an open position to allow the flexible strap to slide through the channel and a closed position to pinch the flexible strap in the channel to fix a position of the movable cam activated attachment point along the flexible strap. First and second hooks can be coupled to the cam activated attachment point.

DETAILED DESCRIPTION OF EMBODIMENTS

Hereinafter, exemplary embodiments of the present inventive concept will be described in detail in conjunction with the accompanying drawings to aid in more clearly understanding the present inventive concept.

Figure 1:
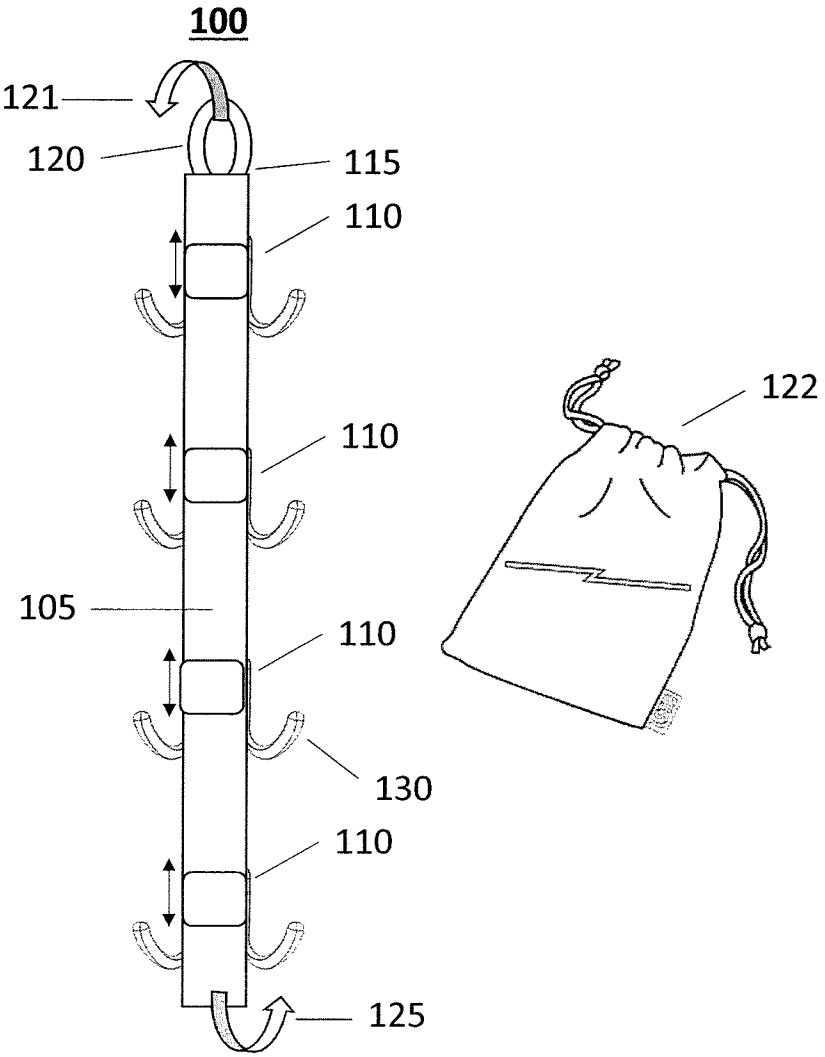
FIG. 1 is a schematic representation of a flexible apparatus including moveable attachment points and related devices in some embodiments according to the invention.

FIG. 1 is a schematic representation of a flexible apparatus 100 including moveable attachment points 110 in some embodiments according to the invention. According to FIG. 1 the flexible apparatus 100 includes the moveable attachment points 110 which are configured to slide along the length of a non-rigid member 105 so that the plurality of moveable attachment points 110 can be variably spaced along the length of the non-rigid member according to specific applications in some embodiments according to the invention.

As further shown in FIG. 1, a top end 115 of the non-rigid member 105 can include a closed loop 120 so that the flexible apparatus 100 can be hung from an overhead object. In alternative embodiments according to the invention, the closed loop 120 can be further attached to a support hanger 121 which may in turn be connected to the overhead object. In some embodiments according to the invention, the non-rigid member can be any flexible material that allows for the flexible apparatus 100 to be inserted into a carry bag 122 shown in FIG. 1.

As shown in FIG. 1, in some embodiments according to the invention, the non-rigid member 105 can be a flexible strap that is made from a fabric, such as a synthetic or natural material, which is washable to remove odors and dirt from the non-rigid member 105. It will be further understood that in some embodiments according to the invention, a second support hook 121 can be coupled to a bottom end 125 of the non-rigid member 105 such that the entire flexible apparatus 100 can be suspended between two overhead objects.

It will be further understood that at least one of the plurality of moveable access points 110 shown in FIG. 1 can be other devices such as a deodorizer. Still further, the moveable attachment points 110 can include a plurality of hooks 130 coupled to the moveable attachment points from which objects can be hung for drying such as sports equipment.

Figure 2A:
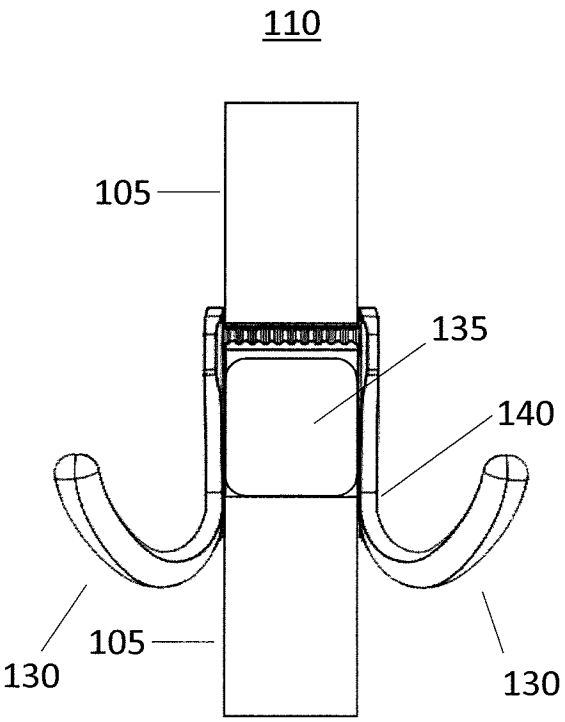
FIG. 2A is a schematic representation of a front view of a moveable attachment point including first and second hooks and a cam lever in some embodiments according to the invention.

FIG. 2A is a schematic representation of a front view of a moveable access point 110 shown in FIG. 1 including first and second hooks 130 which extend from a body of the moveable attachment point in different directions so that the equipment can hung from the moveable attachment point 110. As further shown in FIG. 2A, the moveable attachment point 110 can include a cam lever 135 which pivots between a closed position and an open position so that in the open position a channel is defined therethrough which the non-rigid member 105 can be threaded so that the equipment may be hung from the flexible apparatus 100 for drying.

Figure 2B:
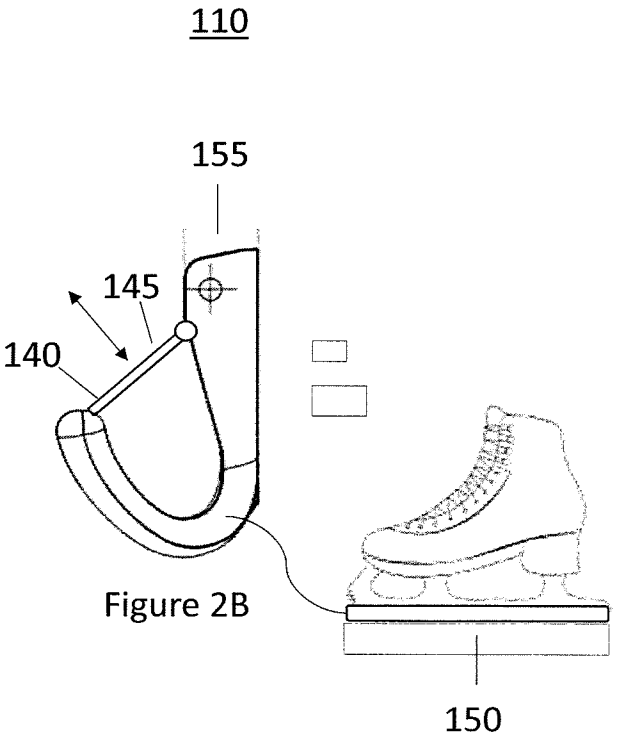
FIG. 2B is a side view of the moveable attachment point shown in FIG. 2A with an additional moveable closure to close off the opening and a skate blade guard coupled thereto in some embodiments according to the invention.
Figure 2C:
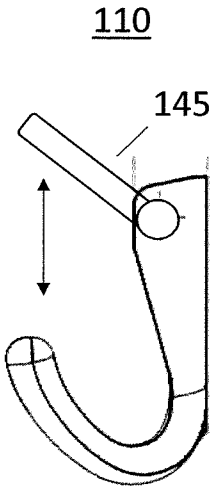
FIG. 2C is a side view of the moveable attachment point shown in FIG. 2A with the closure shown in the open position in some embodiments according to the invention.

FIG. 2B is a schematic representation of a side view of the moveable attachment point 110 shown in FIG. 2A and further including a moveable closure 145 as well a skate blade guard 150 coupled thereto. According to FIG. 2B, the channel 155 is shown being accessed from the top of the moveable attachment point 110 so that the non-rigid member 105 can be threaded from the top into the channel from the top of the moveable attachment point 110 to the bottom of the moveable attachment point 110. Still further, the moveable closure 145 is shown in the closed position but is moveable to an open position to access the opening 140 so that equipment can be hung from the hook 130 and retained during movement of the flexible apparatus 100. FIG. 2C is an alternative side view of the moveable access point 110 including the closure 145 shown in the open position 145.

Figure 2D:
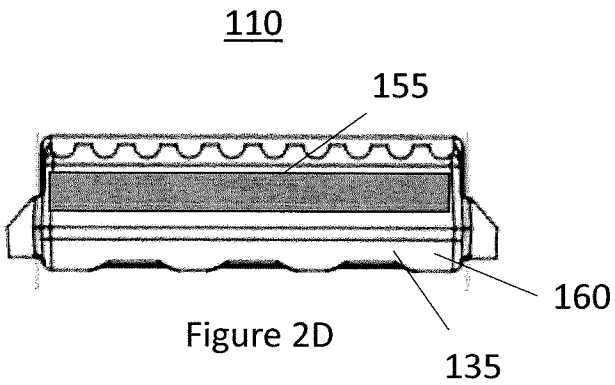
FIG. 2D is a top view of the moveable attachment point shown in FIG. 2A highlighting the channel located between the cam lever and the back of the moveable attachment point in some embodiments according to the invention.

FIG. 2D is a top view of the moveable attachment point 110 showing the cam lever 135 in the closed position so that the channel 155 is constrained between the cam lever 135 in the closed position and the back surface 160 of the moveable attachment point 110 so that in the closed position the non-rigid member is pinched in the channel to fix a position of the moveable attachment point 110 along the non-rigid member 105 in some embodiments according the invention.

Figure 2E:
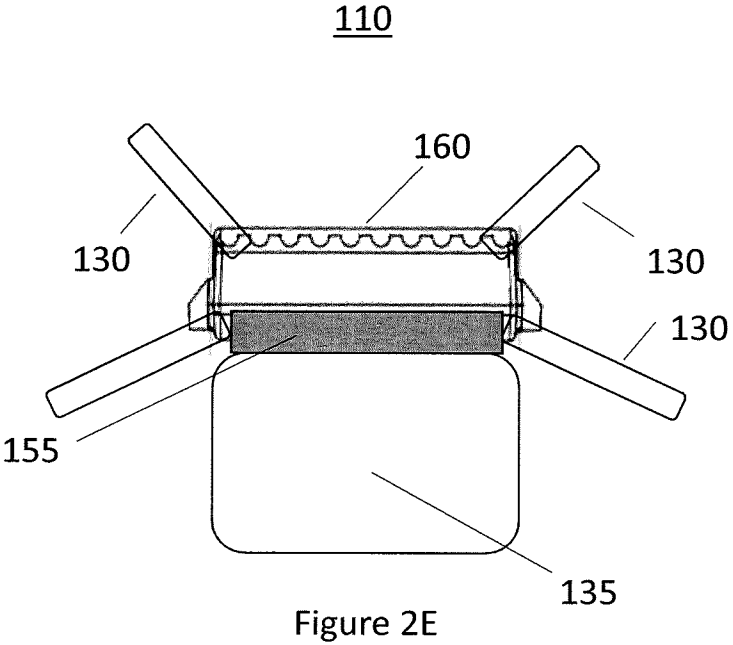
FIG. 2E is a top view of the moveable attachment point shown in FIG. 2A with the cam lever in the open position showing the channel allowing movement of a non-rigid member there through and additional hooks located on a back side and side surfaces of the moveable attachment point along with a high visibility visual indicator in some embodiments according to the invention.

FIG. 2E is a top view of the moveable attachment point 110 with the cam lever 135 shown in the open position so that the channel 155 is unconstrained so that the non-rigid member can freely slide through the channel 155 so that the moveable attachment point 110 can be repositioned at any position along the non-rigid member 105. As further shown in FIG. 2E, additional hooks 130 are shown on the moveable attachment point 110 on the back surface 160 as well as on the side surface. Still further, at least one of the hooks 130 include the high visibility visual indicator which can be used to visually indicate when a piece of equipment is missing from an assigned location so to serve as a reminder to avoid misplacing equipment which should be attached to the flexible apparatus 100.

While the inventive concepts have been described with reference to example embodiments, it will be apparent to those skilled in the art that various changes and modifications may be made without departing from the spirits and scopes of the inventive concepts. Therefore, it should be understood that the above embodiments are not limiting, but illustrative. Thus, the scopes of the inventive concepts are to be determined by the broadest permissible interpretation of the following claims and their equivalents, and shall not be restricted or limited by the foregoing description.

What is claimed:

1. An apparatus comprising:

a non-rigid member including a top end and a bottom end;

a plurality of movable attachment points configured to variably space apart along the non-rigid member between the top end and the bottom end; and first and second hooks coupled to at least one of the plurality of movable attachment points to form a unitary structure, wherein the at least one the plurality of movable attachment points further includes:

a channel through which the non-rigid member is threaded; and a cam lever movable between an open position to allow the non-rigid member to slide through the channel and a closed position to pinch the non-rigid member in the channel to fix a position of the movable attachment point along the non-rigid member, wherein the first hook includes a closure extending across an opening of the first hook to capture an item between the first hook and the closure.

2. The apparatus of claim 1 wherein the top end of the non-rigid member comprises a closed loop.

3. The apparatus of claim 1 wherein the first and second hooks are coupled to respective first and second opposite side surfaces of each of the plurality of movable attachment points.

4. The apparatus of claim 3 wherein the apparatus further comprises:

a third hook on a back surface of each of the plurality of movable attachment points.

5. The apparatus of claim 1 further comprises a support hanger including an opening configured to couple to the top end of the non-rigid member.

6. The apparatus of claim 1 wherein the non-rigid member comprises a flexible strap.

7. The apparatus of claim 6 further comprising:

a carry bag including an opening therein configured to store the flexible strap and the plurality of movable attachment points.

8. The apparatus of claim 5 wherein the support hanger comprises a first support hanger, the apparatus further comprising:

a second support hanger configured to couple to the bottom end of the non-rigid member.

9. The apparatus of claim 1 further comprising:

a hook and loop attachment point included on the non-rigid member.

10. The apparatus of claim 1 wherein the first hook includes a high visibility visual indicator on an interior surface of first hook.

11. The apparatus of claim 1 further comprising:

a skate blade guard coupled to one of the plurality of movable attachment points.

12. The apparatus of claim 6 wherein the flexible strap comprises a washable material.

13. The apparatus of claim 1 further comprising:

a deodorizer coupled to one of the plurality of movable attachment points.

14. An apparatus comprising:

a non-rigid member including a top end and a bottom end;

a plurality of movable attachment points configured to variably space apart along the non-rigid member between the top end and the bottom end; and a deodorizer coupled to one of the plurality of movable attachment points;

first and second hooks coupled to each of the plurality of movable attachment points, wherein the first hook includes a closure extending across an opening of the first hook to capture an item between the first hook and the closure, wherein each of the plurality of movable attachment points includes:

a channel through which the non-rigid member is threaded; and a cam lever movable between an open position to allow the non-rigid member to slide through the channel and a closed position to pinch the non-rigid member in the channel to fix a position of the movable attachment point along the non-rigid member.

* * * * *